US007832412B2

(12) United States Patent
Xue et al.

(10) Patent No.: US 7,832,412 B2
(45) Date of Patent: Nov. 16, 2010

(54) SURFACE MODIFIED ADSORBENTS AND USE THEREOF

(75) Inventors: Lixin L. Xue, Midlothian, VA (US); Kent B. Koller, Chesterfield, VA (US)

(73) Assignee: Phillip Morris USA Inc., Richmond, VA (US)

( * ) Notice: Subject to any disclaimer, the term of this patent is extended or adjusted under 35 U.S.C. 154(b) by 1030 days.

(21) Appl. No.: 11/252,772

(22) Filed: Oct. 19, 2005

(65) Prior Publication Data

US 2006/0086366 A1 Apr. 27, 2006

Related U.S. Application Data

(60) Provisional application No. 60/621,544, filed on Oct. 25, 2004.

(51) Int. Cl.
*A24D 3/00* (2006.01)

(52) U.S. Cl. ..... 131/334; 502/400; 502/417; 131/331; 131/207

(58) Field of Classification Search ..... 131/334, 131/207, 331, 360–368; 502/400, 417
See application file for complete search history.

(56) References Cited

U.S. PATENT DOCUMENTS 3,664,352 A 5/1972 Norman et al.
3,875,949 A 4/1975 Harendza-Harinxma et al.
3,889,691 A * 6/1975 Urbanic ..... 131/334
4,182,743 A 1/1980 Rainer et al.
4,195,649 A 4/1980 Noguchi et al.
4,204,980 A 5/1980 Pasha et al.
4,483,833 A 11/1984 Stogryn et al.
5,060,672 A * 10/1991 Irimi et al. ..... 131/331
5,076,294 A * 12/1991 Kramer ..... 131/331
5,206,204 A 4/1993 Tsutsumi et al.
5,360,023 A 11/1994 Blakley et al.
5,462,908 A 10/1995 Liang et al.
5,549,125 A 8/1996 White
5,568,819 A 10/1996 Gentry et al.
5,904,908 A * 5/1999 Suzuki et al. ..... 423/228
6,080,457 A 6/2000 Charlton et al.
6,209,547 B1 4/2001 Koller et al.
6,257,242 B1 7/2001 Stavridis
2005/0092176 A1 * 5/2005 Ding et al. ..... 95/90

* cited by examiner

*Primary Examiner*—Kat Wyrozebski
*Assistant Examiner*—Scott W Dodds
(74) *Attorney, Agent, or Firm*—Buchanan Ingersoll & Rooney PC

(57) ABSTRACT

A surface-modified adsorbent comprises a reagent on a porous carrier. Preferred porous carriers are adsorbent carbons such as activated carbon, silica gels, aluminas, polyester resins, zeolites or zeolite-like materials, and mixtures thereof. Preferred reagents are 2-hydroxymethylpiperidine (2-HMP) or a 2-HMP analogue. Surface modified adsorbents can be incorporated into cigarettes, preferably in an amount effective to reduce the concentration of one or more constituents of cigarette smoke.

20 Claims, 9 Drawing Sheets

SURFACE MODIFIED ADSORBENTS AND USE THEREOF

CROSS REFERENCE TO RELATED APPLICATIONS

This application claims priority under 35 U.S.C. §119(e) to U.S. provisional Application No. 60/621,544 filed on Oct. 25, 2004, the entire content of which is incorporated herein by reference.

BACKGROUND

Porous sorbent materials such as adsorbent carbon, activated carbon, silica gel, alumina, polyester resins, zeolites or zeolite-like materials, and mixtures thereof can be effective in removing a wide spectrum of gas phase constituents from mainstream cigarette smoke when incorporated in cigarette filters. However, their lack of selectivity between smoke constituents may cause reduced shelf life and poor smoke subjectives. To improve filtration performance in cigarette filters, activated carbon, silica gel, and other porous substrates can be modified with chemical reagents that can target specific smoke constituents.

SUMMARY

According to a preferred embodiment, a surface-modified adsorbent comprises a reagent incorporated in a porous carrier, the reagent comprising 2-HMP or an analogue thereof. The porous carrier is preferably an adsorbent carbon, activated carbon, silica gel, alumina, polyester resin, zeolite or zeolite-like material, or mixture thereof, and more preferably activated carbon comprising at least about 80% micropores and having an average particle size from about 6 mesh to about 300 mesh or an average particle size from about 0.2 mm to about 1 mm. In a preferred embodiment, the reagent can comprise 1 to 80% or 3 to 10% by weight of the adsorbent.

The reagent preferably comprises 2-hydroxymethylpiperidine (2-HMP) or a 2-HMP analogue such as 2-(2-piperidine) ethanol (2-PE), N-piperidineethanol (N-PE), 2-(4-piperidine)ethanol (4-PE), 3-hydroxypiperidine hydrochloride (3-HPH), 4-hydroxypiperidine (4-HP), 3-N-piperidinyl-1,2-propanediol (3-PDP), 2-amino-1-phenylethanol (2-APE), 2-(N-anilino)ethanol (2-AE) or S-(−)2-phenylglycinol (2-PG).

The surface-modified adsorbent (e.g., adsorbent beads) can be incorporated into a cigarette (e.g., a cigarette filter) in an amount effective to reduce the concentration of mainstream tobacco smoke constituents such as carbon dioxide, hydrogen cyanide, ethane, 1,3-butadiene, isoprene, cyclohexadiene, 1,3-cyclohexadiene, methyl cyclopentadiene, formaldehyde, acetaldehyde, acrolein, acetone, diacetyl, methyl ethyl ketone, cyclopentanone, benzene, toluene, acrylonitrile, methyl furan, 2,5 dimethyl furan, hydrogen sulfide, methyl mecaptan, propene, propadiene, carbonyl sulfide, propionaldehyde, butyraldehyde, methanol, and 1-methylpyrrole. For example, the reagent can be incorporated in a cigarette in an amount effective to reduce the concentration in mainstream smoke of hydrogen cyanide, 1,3-butadiene, formaldehyde, acetaldehyde, acrolein, diacetyl, acrylonitrile, and hydrogen sulfide by at least 90%. A preferred filter comprises a plug-space-plug configuration having the surface-modified adsorbent incorporated in the space between the plugs.

DETAILED DESCRIPTION OF PREFERRED EMBODIMENTS

Porous sorbent materials such as adsorbent carbon, activated carbon, silica gel, alumina, polyester resins, zeolites or zeolite-like materials, and mixtures thereof can be used to adsorb a wide spectrum of gas phase constituents from mainstream cigarette smoke when incorporated in cigarette filters. However, the lack of selectivity of these materials for specific smoke constituents may cause reduced shelf life and poor smoke subjectives. To improve filtration performance in cigarette filters, activated carbon can be modified with chemical reagents that can specifically react with targeted smoke constituents.

In an embodiment, a porous substrate such as carbon (e.g., activated carbon) or silica gel is treated with a reagent such as 2-HMP or one or more analogues thereof to form a surface modified adsorbent. Analogues of 2-HMP such as 3-N-piperidinyl-1,2-propanediol (3-PDP) and S-(−)-2-phenylglycinol (2-PG) comprise the functional groups —NH— and —O, which can react with carbonyl (═C═O) or nitrile (—CN) groups of targeted tobacco smoke constituents. Additional 2-HMP analogues include 2-(2-piperidine)ethanol (2-PE), N-piperidineethanol (N-PE), 2-(4-piperidine)ethanol (4-PE), 3-hydroxypiperidine hydrochloride (3-HPH), 4-hydroxypiperidine (4-HP), 2-amino-1-phenylethanol (2-APE), and 2-(N-anilino)ethanol (2-AE).

The filtration efficiency of chemically modified porous substrates can depend on the loading level of the reagent. For a porous carbon substrate, it has been found that for higher levels of reagent loading, e.g., 25% or more of 2-HMP by weight, adsorbent selectivity for targeted tobacco smoke constituents (i.e., chemisorption) can be achieved. At higher levels of loading, the pores on the surface of the porous substrate can be flooded by an excess of reagent, and the physical adsorption (physisorption) of non-reactive constituents such as 1,3-butadiene can be mostly blocked. Reactive smoke constituents include hydrogen cyanide, formaldehyde, acrolein and diacetyl.

For lower levels of loading, e.g., 5-10% of 2-HMP by weight, modified carbons with improved activity for removing a broad range of constituents can be obtained. Surface modified carbon comprising lower levels of chemical loading can adsorb both chemically reactive and non-chemically reactive constituents. A hypothesis for this observation is the formation of an intermediate impregnation stage where the physical adsorption surface area of carbon can be increased after the impregnation. Similar effects in filtration performance were also observed in carbons treated with 2-HMP analogues such as 3-N-piperidinyl-1,2-propanediol (3-PDP) and S-(−)-2-phenylglycinol (2-PG), the formulas of which are:

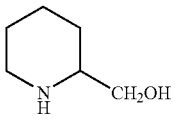

2-Hydroxy-methyl-piperidine (2-HMP)

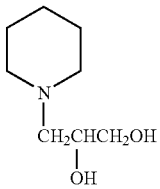

3-N-Piperidinyl, 1,2-propanediol (3-PDP)

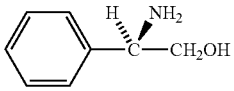

S-(-)-2-Phenylglycinol (2-PG)

Figure 1:
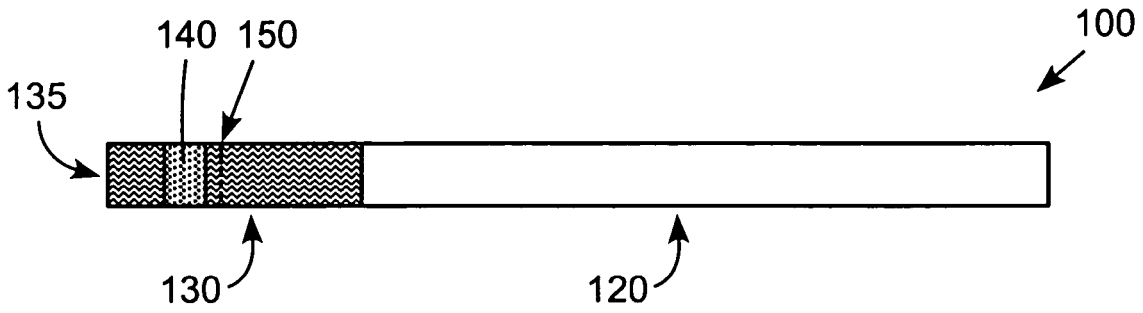
FIG. 1 is a schematic of a test cigarette with a surface modified absorbent in the filter used for measuring reductions in constituents of tobacco smoke.

Surface modified adsorbents having different loading levels of reagent can be prepared and incorporated into a test cigarette. FIG. 1 shows a modified 1R4F reference cigarette 100 used for evaluating surface modified adsorbents. The cigarette includes a tobacco rod 120 and a modified cigarette filter 130 wherein surface modified adsorbents 140 such as surface modified carbon granules are incorporated in a cavity within 8 mm from the free end 135 of the filter. The filter further comprises dilution holes 150 upstream of the adsorbent material.

Figure 2:
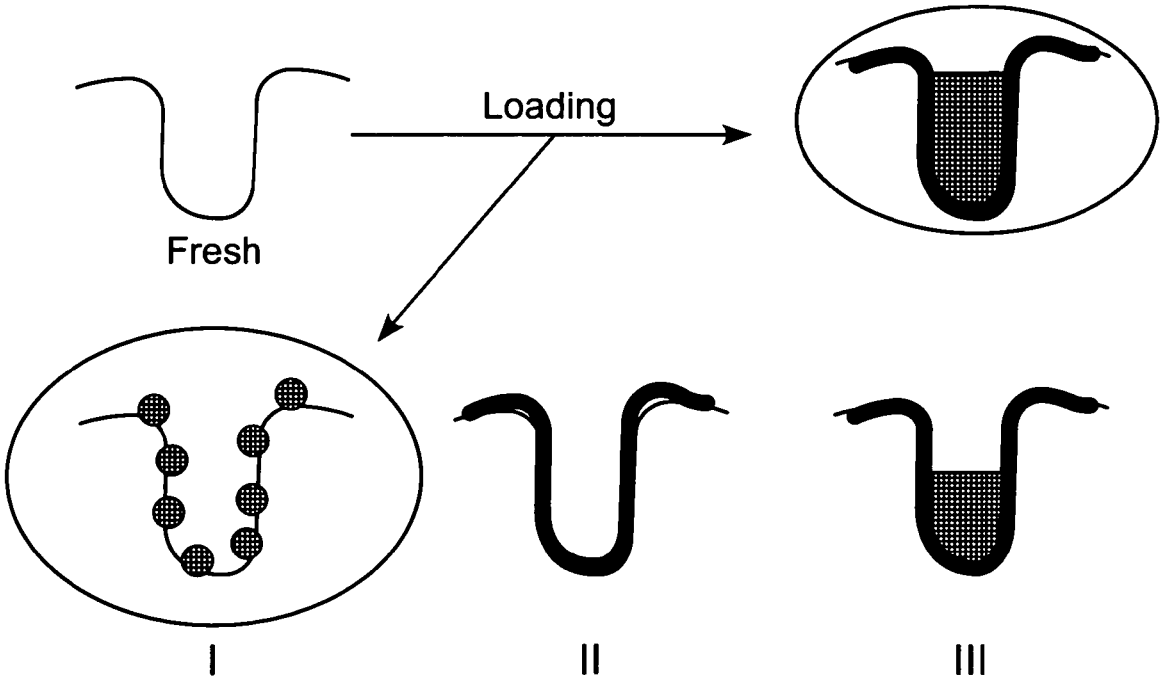
FIG. 2 shows a model of surface modification of carbon.

FIG. 2 shows a model of surface modification by 2-HMP reagent of carbon. It is believed that at lower levels of loading the carbon comprises an intermediate impregnation stage (e.g., Stage I) where the physical adsorption surface area of the carbon is increased with reagent impregnation. As shown in Stage I of FIG. 2, at lower levels of reagent addition, the surface area of the adsorbent for non-reactive gas phase constituents may be retained or even enlarged. With increasing levels of reagent addition, a coating or continuous layer of the reagent can form on the pores of the substrate (Stage II). At still higher levels of reagent addition, the pores can be flooded with reagent (Stage III) and the modified adsorbents can be increasingly selective to reactive smoke constituents. However, it is believed that for Stage I loading, which comprises a partial or sporadic coating of reagent, a higher adsorption activity for a broad spectrum of compounds can be achieved with respect to untreated porous substrate materials and substrate materials treated with higher levels of reagent (e.g., Stage II or Stage III).

EXAMPLES

Porous carriers such as carbon, activated carbon, silica gel, alumina, polyester resins, zeolites, zeolite-like materials such as mesoporous silica and the like can be treated with 2-HMP reagent or an analogue thereof to improve tobacco smoke filtration performance. For example, granules of the carrier material can be mixed with a liquid containing the reagent, and the infiltrated granules can be dried under a flowing gas such as air or nitrogen to obtain an impregnated carrier having a desired loading of reagent.

Commercially-available PICA-G277 carbon granules or commercially-available Grace Davison silica gel particles were used as the porous carrier (i.e., substrate) to form surface modified adsorbent particles. The particle sizes for both the carbon and silica gel ranged from about 35×60 mesh to 20×50 mesh.

In a typical synthesis, 2 g of the porous substrate was mixed thoroughly with an aqueous solution containing 0.1 g of 2-HMP solids (or 2-HMP analogue) and about 2 g of water. The mixture was then dried overnight at room temperature in a venting oven, resulting in about 3.6 g of surface modified adsorbent.

Table 1 sets forth examples of various reagents loaded on G-277 carbon wherein the reagents are identified as follows: 2-hydroxymethylpiperidine (2-HMP), 2-(2-piperidine)ethanol (2-PE), N-piperidineethanol (N-PE), 2-(4-piperidine) ethanol (4-PE), 3-hydroxypiperidine hydrochloride (3-HPH), 4-hydroxypiperidine (4-HP), 3-N-piperidinyl-1,2-propanediol (3-PDP), 2-amino-1-phenylethanol (2-APE), 2-(N-anilino)ethanol (2-AE), and S-(−)2-phenylglycinol (2-PG). Table 4 shows that the preparation of modified carbon can be an efficient process with nearly 100% recovery. The relatively low yield of 89% (for 2-APE) is believed to be due to loss of sample during handling.

TABLE 1

Synthesis of Surface Modified Carbon.

| | Reagent | Reagent added (g) | G-277C added (g) | Water added (g) | Products (g) | Yield % |
|---|---|---|---|---|---|---|
| 1 | 2-HMP | 0.50 | 9.50 | 2.00 | 10.00 | 100% |
| 2 | 3-HPH | 0.52 | 9.50 | 2.01 | 9.86 | 98% |
| 3 | 2-PG | 0.50 | 9.50 | 3.00 | 9.93 | 99% |
| 4 | 3-PDP | 0.50 | 9.50 | 2.00 | 9.96 | 100% |
| 5 | 2-APE | 0.50 | 9.51 | 2.00 | 8.88 | 89% |
| 6 | 2-PE | 0.52 | 9.54 | 2.10 | 9.96 | 99% |
| 7 | N-PE | 0.52 | 9.50 | 3.00 | 10.02 | 100% |
| 8 | 4-PE | 0.50 | 9.56 | 2.00 | 9.92 | 99% |
| 9 | 2-AE | 0.58 | 9.56 | 2.20 | 10.01 | 99% |
| 10 | 4-HP | 0.50 | 9.51 | 2.01 | 10.00 | 100% |

Table 2 sets forth examples of various reagents loaded on silica gel. Table 2 shows that the preparation of modified silica gel can be an efficient process with nearly 100% recovery.

TABLE 2

Synthesis of Surface Modified Silica Gel

| | Reagent | Reagents added (g) | Silica Gel added (g) | Water added (g) | Products (g) | Yield % |
|---|---|---|---|---|---|---|
| 1 | 2-HMP | 0.99 | 2.01 | 1.04 | 2.97 | 99% |
| 2 | 3-HPH | 1.00 | 2.00 | 1.06 | 2.86 | 95% |
| 3 | 2-PG | 1.00 | 2.00 | 1.02 | 2.82 | 94% |
| 4 | 3-PDP | 1.01 | 2.00 | 1.04 | 3.00 | 100% |
| 5 | 2-APE | 1.00 | 2.00 | 1.02 | 3.00 | 100% |
| 6 | 2-PE | 1.04 | 2.01 | 2.00 | 3.00 | 99% |
| 7 | N-PE | 1.00 | 1.99 | 1.00 | 3.02 | 101% |
| 8 | 4-PE | 1.04 | 2.00 | 2.00 | 2.87 | 94% |
| 9 | 2-AE | 1.05 | 2.01 | 2.06 | 2.91 | 95% |
| 10 | 4-HP | 1.00 | 2.00 | 1.00 | 2.96 | 99% |

The multiplex puff-by-puff GC/MS method, which is described by Thomas et al., "Puff-by-puff Mainstream Smoke Analysis by Multiplex Gas Chromatography/Mass Spectrometry," CORESTA, 2000, was used to evaluate the filtration performance of the surface modified adsorbent particles in 1R4F cigarettes. Results from the testing are shown in Table 3 wherein the % reduction of the various smoke constituents are shown for impregnated carbon (1 wt. %, 5 wt. % and 25 wt. % 2-HMP) and non-impregnated carbon (0 wt. %). In Table 3, the absence of data corresponds to filtration activity (i.e., reduction in constituent concentration) of less than 30%.

TABLE 3

Filtration Performance of 2-HMP Modified Carbon.

| | 2-HMP (wt. %) | | | |
|---|---|---|---|---|
| Compound | 0% | 1% | 5% | 25% |
| Hydrogen cyanide | 79 | 84 | 92 | 82 |
| 1,3-butadiene | 90 | 90 | 94 | |
| Isoprene | 89 | 93 | 97 | |
| Cyclopentadiene | 90 | 92 | 96 | |
| 1,3-cyclohexadiene | 90 | 95 | 98 | 42 |
| Methyl cyclopentadiene | 90 | 94 | 98 | |
| Formaldehyde | 75 | 81 | 89 | 99 |
| Acetaldehyde | 81 | 85 | 92 | 54 |
| Acrolein | 93 | 96 | 99 | 70 |
| Acetone | 90 | 90 | 96 | |
| Diacetyl | 89 | 93 | 98 | 73 |
| Methyl ethyl ketone | 91 | 93 | 99 | |
| Cyclopentanone | 85 | 92 | 100 | 48 |
| Benzene | 91 | 94 | 98 | |
| Toluene | 90 | 95 | 99 | |
| Acrylonitrile | 82 | 89 | 98 | 59 |
| Methyl furan | 91 | 94 | 98 | 25 |
| 2,5 dimethyl furan | 91 | 95 | 98 | |
| Hydrogen sulfide | 84 | 83 | 91 | 33 |
| Methyl mecaptan | 71 | 71 | 70 | |
| 1-methyl pyrrole | 90 | 94 | 100 | |

Figure 3:
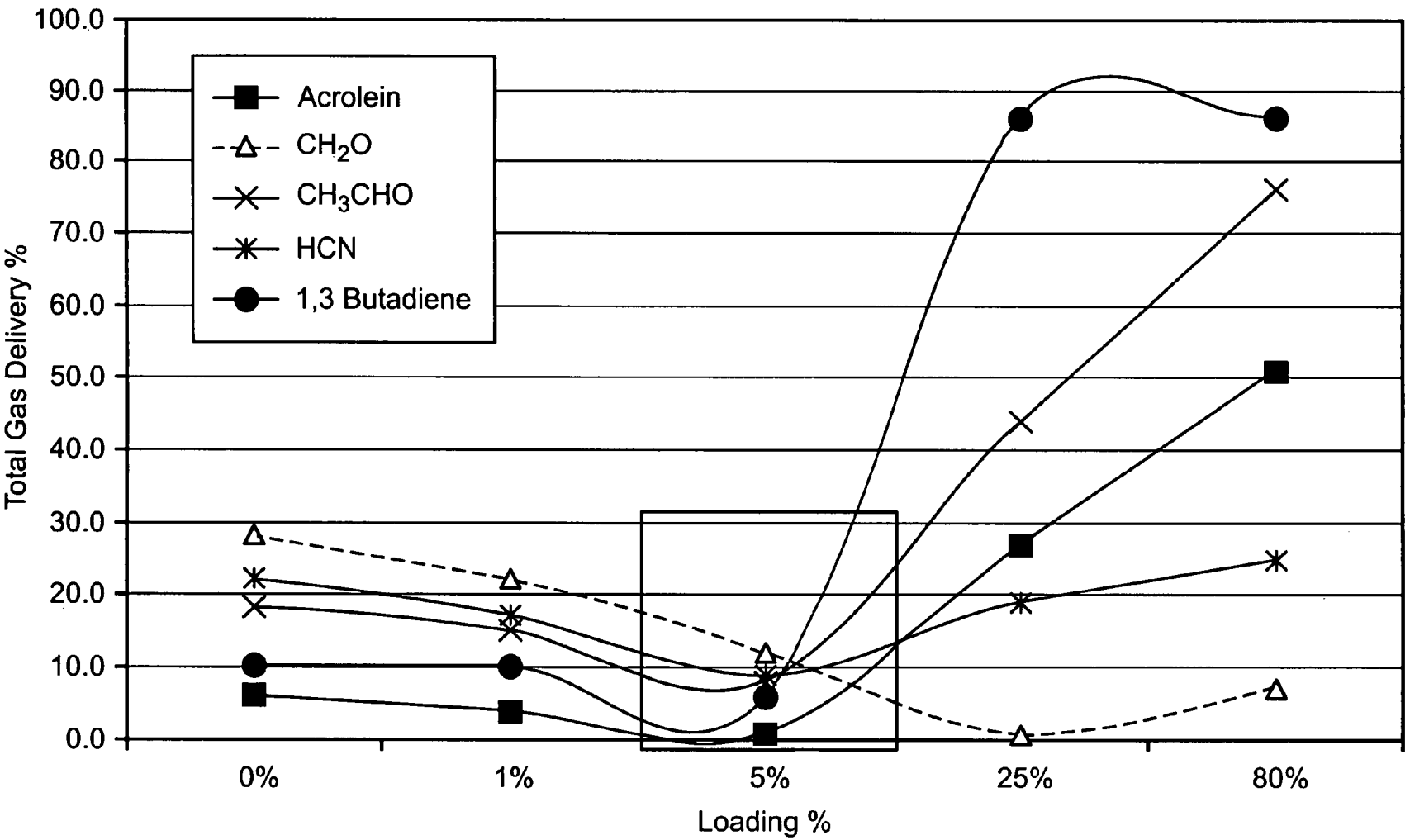
FIG. 3 is a graph of tobacco smoke constituent reduction in acrolein (boxes), formaldehyde (triangles), acetaldehyde (x's), hydrogen cyanide (x's) and 1,3 butadiene (circles) for loadings of 0%, 1%, 5%, 25% and 80% 2-HMP on G-277 carbon.
Figure 4:
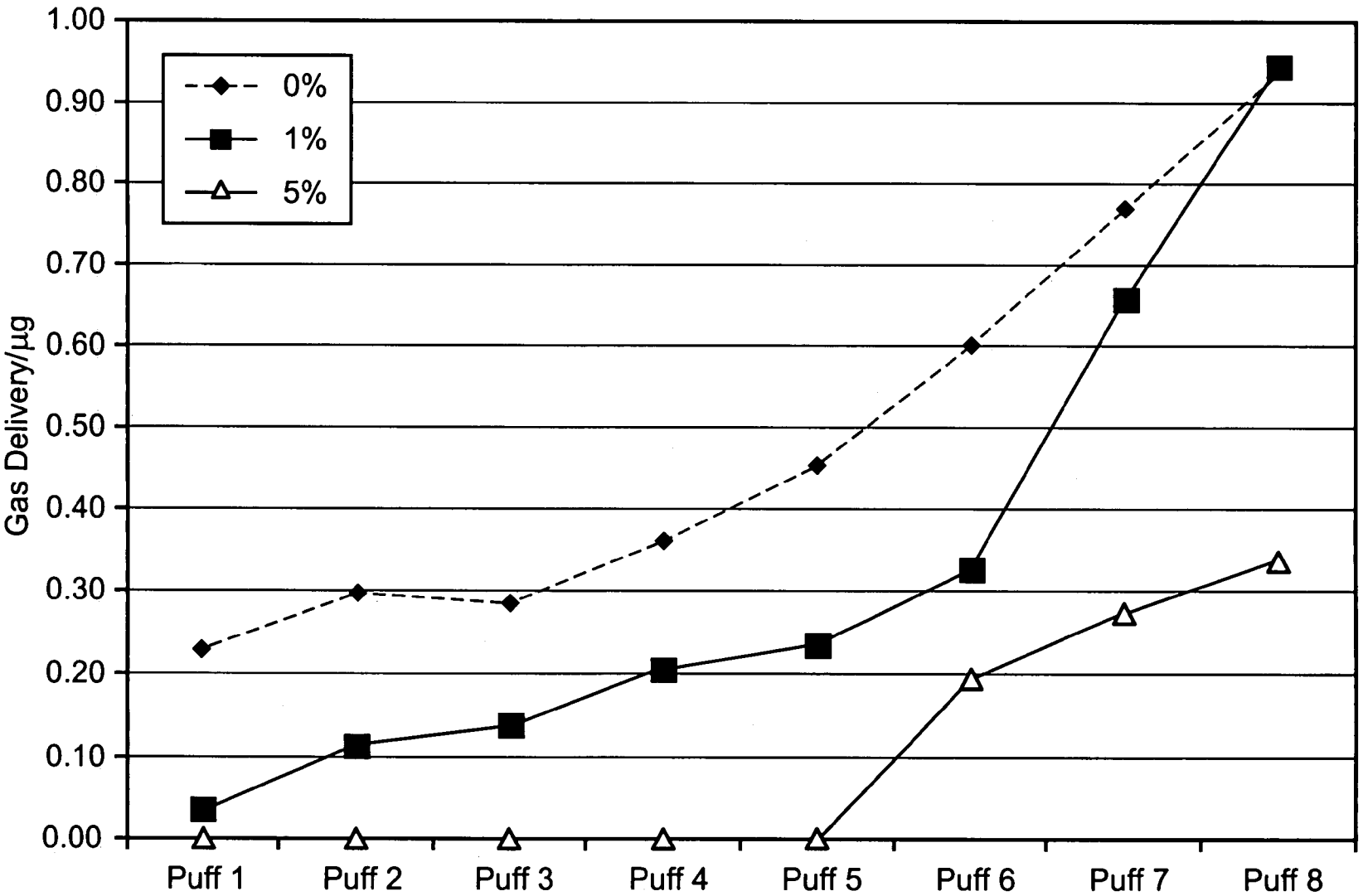
FIG. 4 is a graph of puff-by-puff tobacco smoke constituent reduction in acrolein for loadings of 0% (diamonds), 1% (boxes) and 5% (triangles) of 2-HMP on G-277 carbon.
Figure 5:
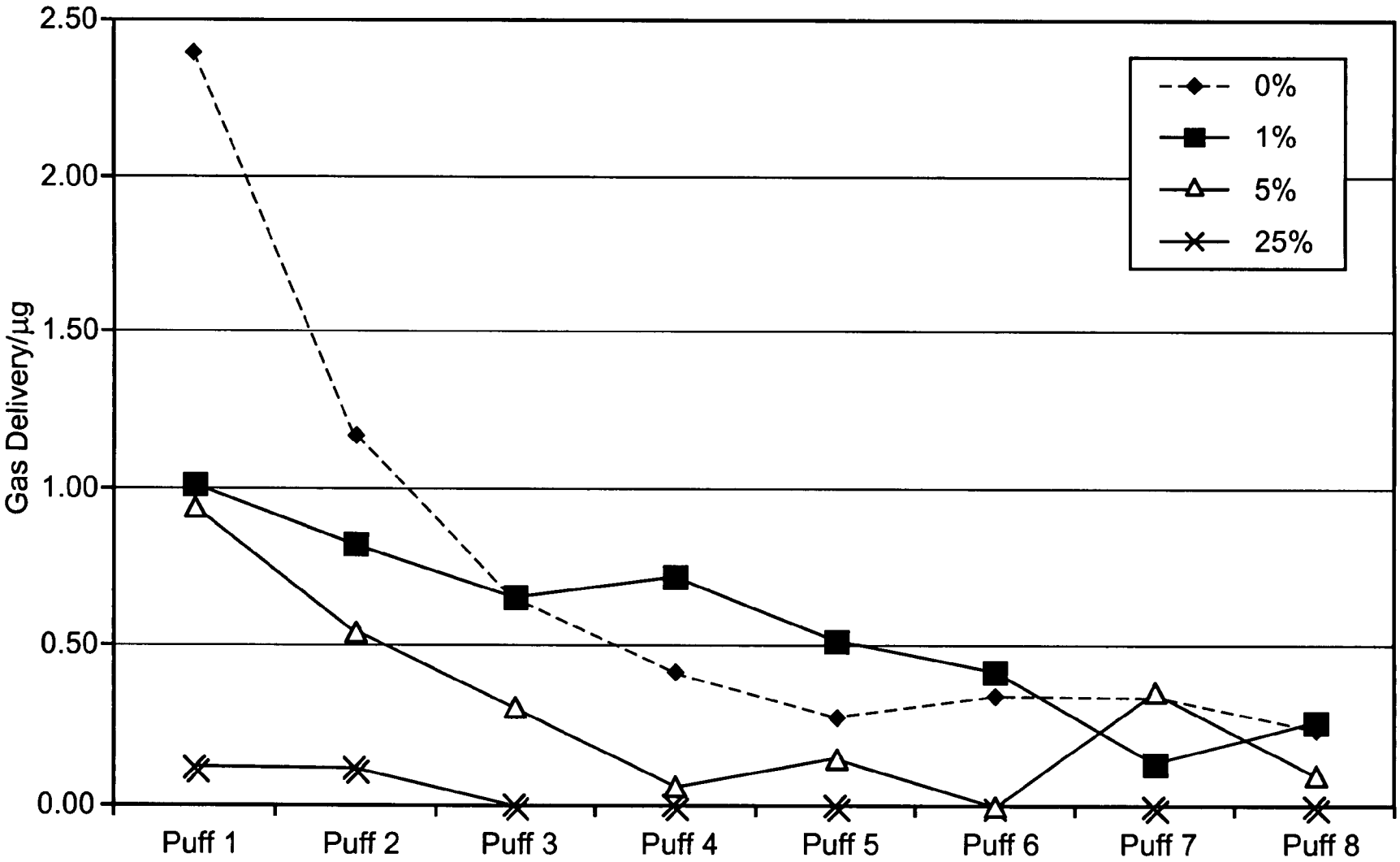
FIG. 5 is a graph of puff-by-puff tobacco smoke constituent reduction in formaldehyde for loadings of 0% (diamonds), 1% (boxes), 5% (triangles) and 25% (X's) of 2-HMP on G-277 carbon.
Figure 6:
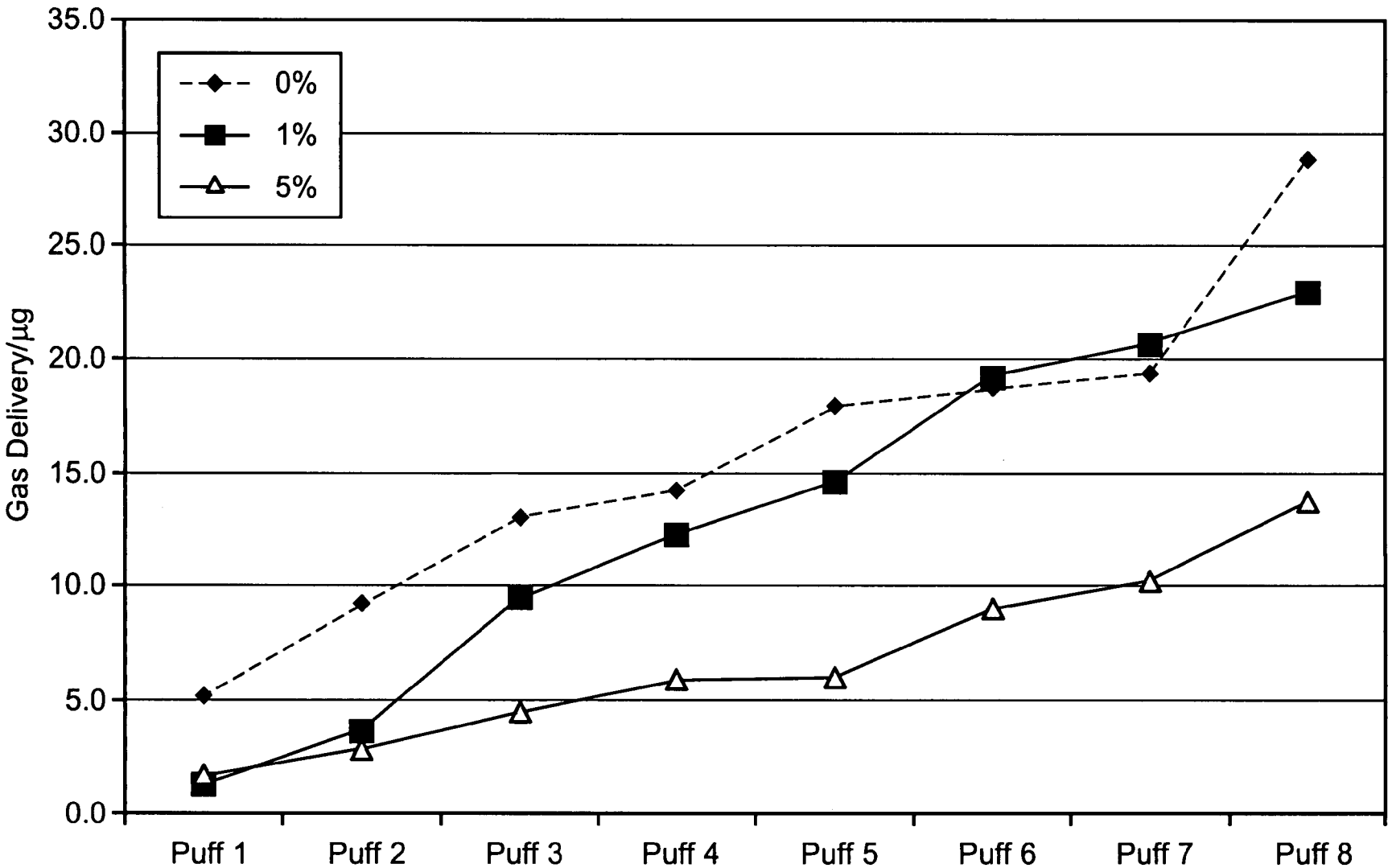
FIG. 6 is a graph of puff-by-puff tobacco smoke constituent reduction in acetaldehyde for loadings of 0% (diamonds), 1% (boxes) and 5% (triangles) of 2-HMP on G-277 carbon.
Figure 7:
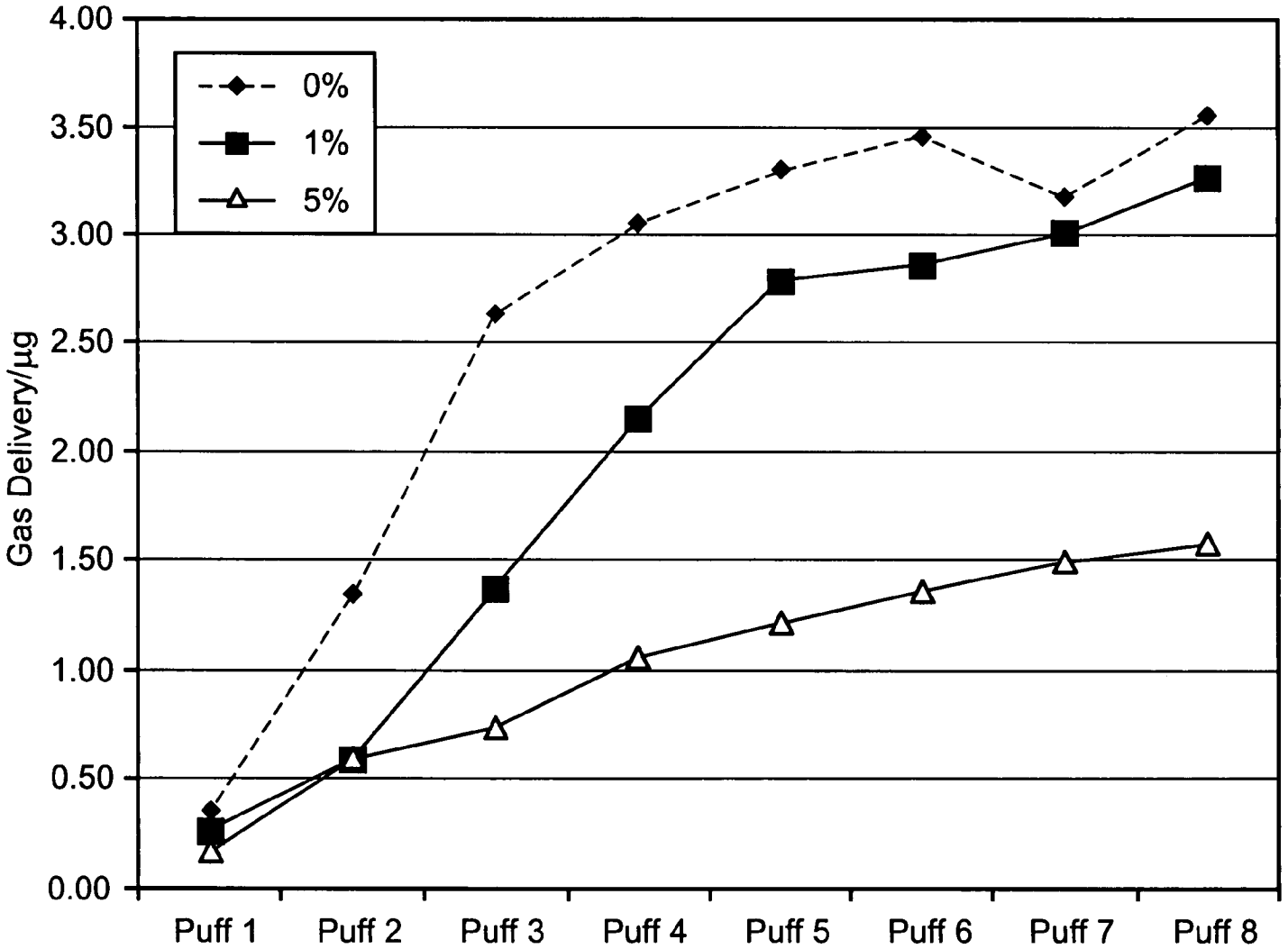
FIG. 7 is a graph of puff-by-puff tobacco smoke constituent reduction in hydrogen cyanide for loadings of 0% (diamonds), 1% (boxes) and 5% (triangles) of 2-HMP on G-277 carbon.
Figure 8:
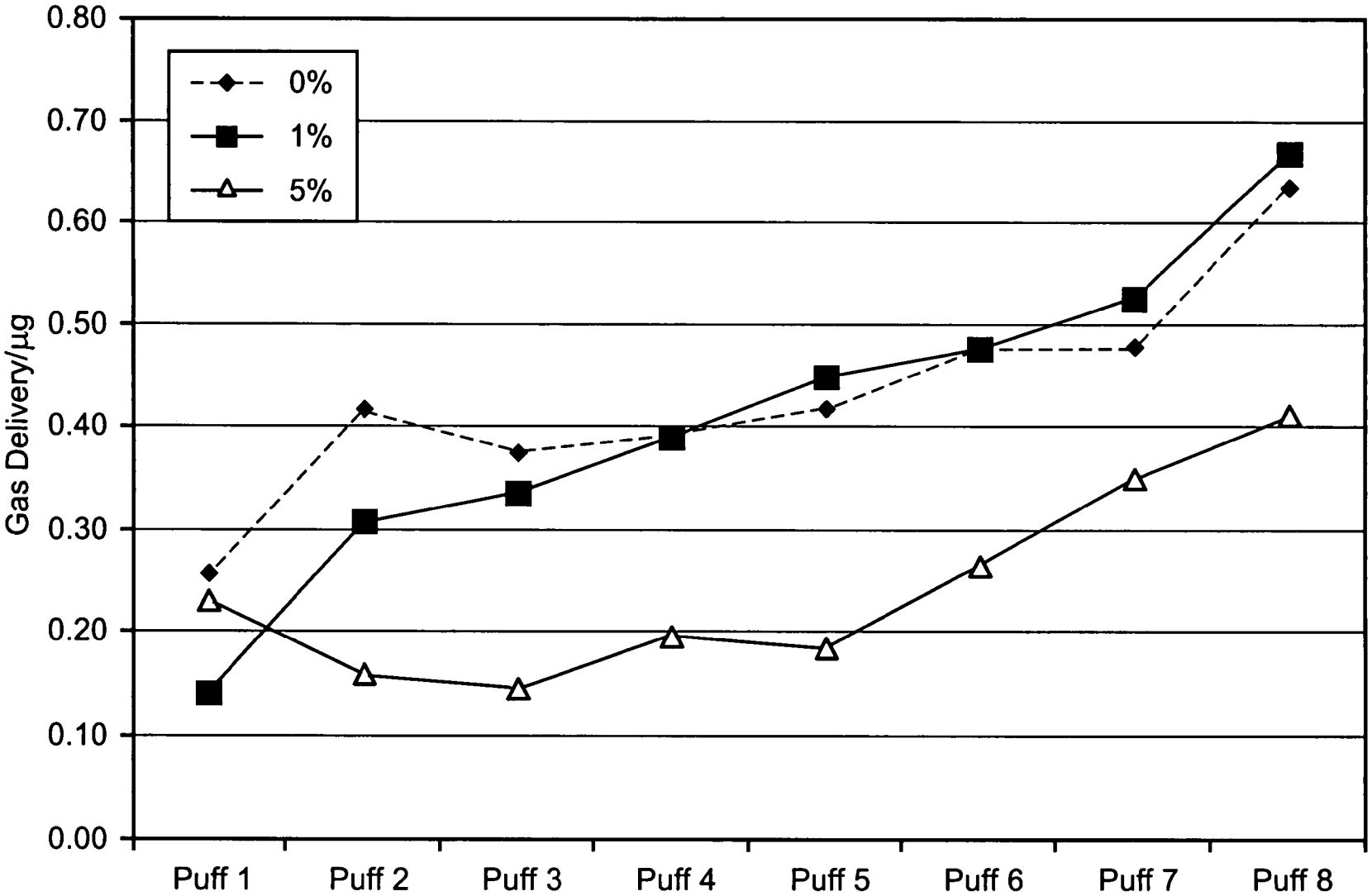
FIG. 8 is a graph of puff-by-puff tobacco smoke constituent reduction in 1,3 butadiene for loadings of 0% (diamonds), 1% (boxes) and 5% (triangles) of 2-HMP on G-277 carbon.

As seen in Table 3, improved filtration can be achieved by treating carbon with a desired level of 2-HMP (e.g., greater than 1 wt. %). FIGS. 3-8 show the effects of 2-HMP impregnation of PICA-G277 carbon (100 mg of adsorbent per cigarette) in tobacco smoke filtration performance. As shown in FIG. 3, the overall performance of the carbon in removing cigarette smoke gas phase constituents can be improved by varying the loading of reagent. At 5 wt. % loading, for example, the surface activated carbon can adsorb compounds that are chemically reactive with 2-HMP (e.g., formaldehyde, acetaldehyde, acrolein, ketones, diacetyl hydrogen sulfide and hydrogen cyanide) and compounds that are substantially non-chemically reactive (e.g., dienes, aromatic compounds, furans, and pyrroles). In FIG. 3, formaldehyde is abbreviated $CH_2O$, acetaldehyde is abbreviated $CH_3CHO$, and hydrogen cyanide is abbreviated HCN.

In general, the filtration performance of porous adsorbent materials (i.e., via physisorption and/or chemisorption) can be improved by incorporating therein an effective amount of reagent. Physisorption is a process whereby a molecule adheres to a surface without the formation of a chemical bond, usually by van der Waals forces or electrostatic attraction. The formation of a chemical bond leads to chemisorption.

The improvement achieved using 2-HMP impregnated carbon can be seen in the puff-by-puff gas delivery data shown in FIGS. 4-8. In each of the respective FIGS. 4-8, the total gas delivery of acrolein, formaldehyde, acetaldehyde, hydrogen cyanide and 1,3 butadiene is plotted for untreated carbon (0%) and 2-HMP treated carbon at reagent loadings of 1%, 5% and optionally 25%. As seen in FIGS. 4-8, by increasing the loading of 2-HMP up to 5 wt. %, the percent reduction for each of the aforementioned smoke constituents can be increased. However, if targeted reduction in formaldehyde is desired, loadings of 25% and above can provide selective removal of formaldehyde.

Figure 9:
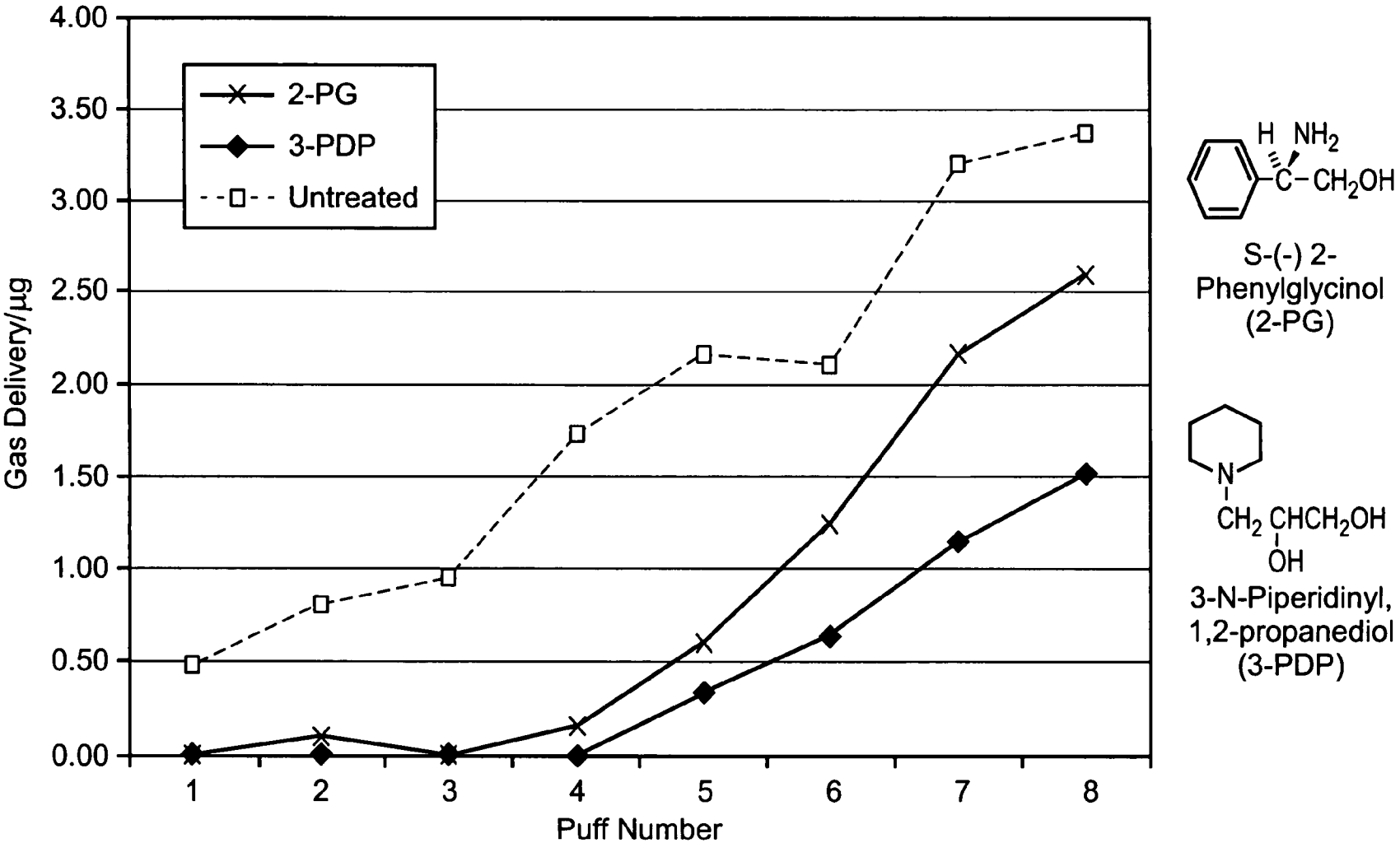
FIG. 9 is a graph of puff-by-puff tobacco smoke constituent reduction in hydrogen cyanide for loadings of 5% 2-PG (x's) and 5% 3-PDP (diamonds) on G-277 carbon and untreated (boxes) G-277 carbon.

FIG. 9 shows effects of 2-PG and 3-PDP impregnation on the filtration performance of G-277 carbon in a 1R4F test cigarette (100 mg/cigarette) compared to untreated carbon. Total gas flow of HCN is plotted for untreated carbon (boxes), 5 wt. % 2-PG (x's) and 5 wt. % 3-PDP (diamonds) for eight puff-by-puff measurements. It can be seen that the surface-modified adsorbents were more effective at removing HCN from the gas stream than the un-modified adsorbent, and that 3-PDP loaded carbon provided greater reduction in HCN than the 2-PG loaded carbon.

Figure 10:
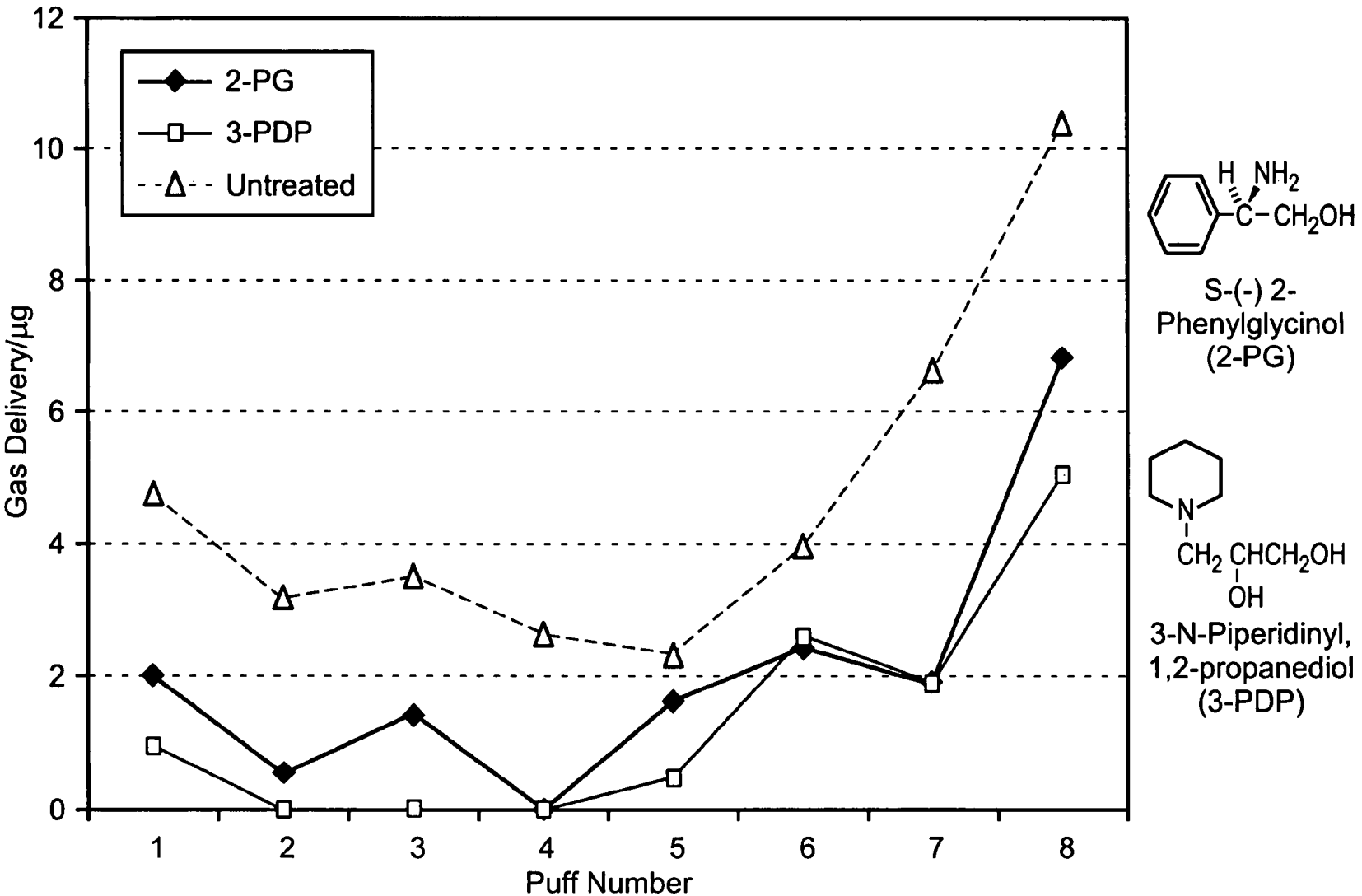
FIG. 10 is a graph of puff-by-puff tobacco smoke constituent reduction in isoprene for loadings of 5% 2-PG (diamonds) and 5% 3-PDP (boxes) on G-277 carbon and untreated (triangles) G-277 carbon.

FIG. 10 shows effects of 2-PG and 3-PDP impregnation of G-277 carbon on tobacco smoke filtration performance in a test cigarette (100 mg/cigarette) compared to untreated carbon. Total gas flow of isoprene is plotted for untreated carbon (triangles), 5 wt. % 2-PG (diamonds) and 5 wt. % 3-PDP (boxes) for eight puff-by-puff measurements. It can be seen that the surface-modified adsorbents were more effective at removing isoprene from the gas stream than the un-modified adsorbent.

From the foregoing, it can be seen that relatively low levels of impregnation (3-10%) provide retained or improved reactivity for a broad range of smoke constituents. On the other hand, high loadings (25% and above) can provide targeted selectivity for constituents such as formaldehyde, acrolein, diacetyl and hydrogen cyanide.

The degree of modification depends on the chemical treatment levels. Under a high level of chemical loading, e.g., at least 25% of 2-HMP by weight, it is believed that the pores of the substrate can be filled with the chemical reagents whereby adsorbent materials with very exclusive high selectivity to hydrogen cyanide, formaldehyde, acrolein, diacetyl can be obtained. Under a lower level of chemical loading, e.g., 5-10% of 2-HMP by weight, materials with improved overall activity to a broad range of smoke constituents may be obtained. For instance, for a 1R4F cigarette comprising 100 mg of modified carbon incorporated in the filter region (e.g., 5-10 wt. % 2-HMP), the concentration of 1,3-butadiene and acrolein in mainstream smoke can be reduce by more than 90%. Replacing the non-impregnated carbon in a test cigarette with 10 wt. % 2-HMP (or analogue thereof) results in undetectable acrolein delivery (<0.08 microgram/cigarette) and no change in dienes delivery (2.4 micrograms/cigarette).

Similar results may be obtained with reagents such as 3-pipiridinal 1,2-propanediol (3-PDP) and S-(−)-2-phenylglycinol (2-PG).

The adsorption results for test cigarettes having a filter comprising silica gel or 2-HMP modified silica gel are shown in Table 4. Corresponding data for surface modified carbon are shown in Table 5. Included in Tables 4-5 are the resistance to draw (RTD) (measured in millimeters of mercury) and direct dilution index (DDI) (measure in percent) data of each test cigarette, as well as the composition (measured in milligrams) of the porous carrier or modified porous carrier that was incorporated into the test cigarette. Also shown in Tables 4-5 is the amount of cellulose acetate (CA) that was replaced by way of the addition of adsorbent material. S1 and S2 stand for repeat tests using commercially-available silica gel (Grace Davison), and C1 and C2 stand for repeat tests using commercially available carbon (PICA). The absence of data corresponds to filtration activity (i.e., reduction in concentration) of less than 30%.

TABLE 4

Filtration Performance of 2-HMP Modified Silica Gel.

| Compound | S1 | S2 | 2-HMP/S1 | 2-HMP/S2 |
|---|---|---|---|---|
| Hydrogen Cyanide | | | 90 | 92 |
| Formaldehyde | 58 | 74 | 94 | 95 |
| Acetaldehyde | 32 | 36 | 35 | 37 |
| Acrolein | 55 | 73 | 63 | 73 |
| Acetone | 72 | 89 | | |
| Diacetyl | 62 | 84 | 92 | 82 |
| Methyl ethyl ketone | 75 | 91 | | |
| Cyclopentanone | 57 | 62 | | 46 |
| Acrylonitrile | 35 | 40 | | |
| Hydrogen Sulfide | | | 35 | 49 |
| 1-methyl Pyrrole | 38 | 64 | | |
| RTD [mm $H_2O$] | 167 | 177 | 173 | 163 |
| DDI % | 25 | 23 | 25 | 23 |
| Substrate [mg] | 77 | 76 | 50 | 50 |
| Reagent [mg] | 0 | 0 | 46 | 46 |
| CA Replaced [mg] | 32 | 23 | 21 | 23 |

In Table 4, for equivalent resistance to draw, untreated silica gel (S1 and S2) showed strong adsorption activity for polar components such as formaldehyde and cyclopentanone, and less activity for acrylonitrile and 1-methyl pyrrole. After treatment with 2-HMP, the modified silica gel were increasingly selective for hydrogen cyanide, formaldehyde and diacetyl. As shown in Tables 4-5, the addition of the modified adsorbent particles to the filter of the test cigarette did not substantially change the resistance to draw or the direct dilution index of the test cigarette.

TABLE 5

Filtration Performance of 2-HMP Modified Activated Carbon

| Compound | C1 | C2 | 2-HMP/C1 | 2-HMP/C2 |
|---|---|---|---|---|
| Propene | 78 | 65 | | |
| Hydrogen Cyanide | 91 | 68 | 86 | 67 |
| Propadiene | 71 | 66 | | |
| 1,3-Butadiene | 97 | 82 | | |
| Isoprene | 97 | 82 | | |
| Cyclopentadiene | 97 | 82 | | |
| 1,3 Cyclohexadiene | 98 | 83 | | |
| Methyl Cyclopentadiene | 97 | 84 | | |
| Formaldehyde | 78 | 72 | 94 | 94 |

TABLE 5-continued

Filtration Performance of 2-HMP Modified Activated Carbon

| Compound | C1 | C2 | 2-HMP/C1 | 2-HMP/C2 |
|---|---|---|---|---|
| Acetaldehyde | 91 | 72 | | |
| Acrolein | 97 | 90 | 49 | 38 |
| Acetone | 97 | 83 | | |
| Diacetyl | 97 | 81 | 72 | 64 |
| Methyl ethyl ketone | 98 | 84 | | |
| Cyclopentanone | 94 | 76 | 41 | 36 |
| Benzene | 98 | 85 | | |
| Toluene | 97 | 82 | 37 | |
| Acrylonitrile | 93 | 71 | | |
| Methyl Furan | 97 | 85 | | |
| 2,5 Dimethyl Furan | 97 | 84 | 42 | |
| Hydrogen Sulfide | 98 | 70 | 44 | |
| Carbonyl Sulfide | 85 | 48 | | |
| Methyl Mecaptan | 78 | 63 | | |
| 1-methyl Pyrrole | 97 | 82 | 35 | |
| RTD [mm $H_2O$] | 155 | 145 | 154 | 151 |
| DDI % | 22 | 28 | 23 | 24 |
| Substrate [mg] | 102 | 107 | 101 | 102 |
| Reagent [mg] | 0 | 0 | 81 | 81 |
| CA Replaced [mg] | 25 | 29 | 27 | 24 |

Table 6 shows the effect of incorporating 200 mg of adsorbent material (untreated G-277 carbon or G-277 carbon loaded with 10 wt. % 2-HMP) in the space of a plug-space-plug filter. The data show the average amount (in micrograms) of each smoke constituent along with the standard deviation for 3 replicas, 10 samples per replica. The data is presented as "average±standard deviation." In Table 6, TPM stands for total particulate matter. As seen in Table 6, the 10 wt. % 2-HMP carbon achieved a high reduction in acrolein and, of the 13 constituents measured, all but three were reduced compared to untreated carbon.

TABLE 6

Effect of Surface Modified Carbon in Plug-Space-Plug Filter.

| Constituent | G-277 (μg/cig) | G-277 + 10 wt. % 2-HMP (μg/cig) | Comparison |
|---|---|---|---|
| Formaldehyde | 9.9 ± 1.3 | 7.1 ± 0.4 | Reduced |
| Acetaldehyde | 27.0 ± 11 | 16.7 ± 4.4 | Reduced |
| Acetone | 102.6 ± 1.2 | 94.3 ± 1.2 | Reduced |
| Acrolein | 3.4 ± 0.5 | <0.08 | Reduced |
| Propionaldehyde | 2.4 ± 0.5 | 1.1 ± 0.4 | Reduced |
| Methyl ethyl ketone | 3.9 ± 1.2 | <2.1 | Reduced |
| Butyraldehyde | 4.3 ± 1.2 | 1.9 ± 0.2 | Reduced |
| 1,3-Butadiene | 2.1 ± 0.1 | 2.4 ± 0.9 | No Change |
| Isoprene | 13.2 ± 0.9 | 17 ± 5 | No Change |
| Acrylonitrile | 0.7 ± 0.1 | 0.5 ± 0.1 | No Change |
| Benzene | 2.9 ± 0.1 | 1.6 ± 0.7 | Reduced |
| Toluene | 6.3 ± 0.7 | 3.3 ± 1.6 | Reduced |
| Styrene | 1.91 ± 0.03 | 0.75 ± 0.08 | Reduced |
| Puff Count | 7.7 ± 0.4 | 7.5 ± 0.2 | No Change |
| TPM (mg/cig) | 8.7 ± 0.1 | 8.4 ± 0.3 | No Change |

Table 7 sets forth adsorption measurements for acetaldehyde (AA), hydrogen cyanide (HCN), methanol (MEOH), and isoprene (ISOP). Total particulate matter is abbreviated (TPM), puff count is abbreviated (PUFF), burn time (in minutes) is abbreviated (BT), direct dilution index is abbreviated (DDI) stance to draw (in millimeters of mercury) is abbreviated (RTD). The test cigarettes used to obtain the data in Table 7 are illustrated in FIG. 1, except the absorbent (80 mg of Grace Davison Grade 646, 35×60 mesh silica gel with approximately 50 wt. % reagent) is incorporated in a cavity between the tobacco rod and the upstream end of the filter. In Table 7, control responds to the data for a control sample, and RSTD is the relative standard deviation for the data for each smoke constituent.

TABLE 7

Filtration Performance of Surface Modified Silica Gel.

| | AA | HCN | MEOH | ISOP | TPM | PUFF | BT | DDI | RTD |
|---|---|---|---|---|---|---|---|---|---|
| control | 0.94 | 0.16 | 0.156 | 0.620 | 0.203 | 9.5 | 8.55 | 30 | 140 |
| RSTD | 2% | 8% | 4% | 1% | 2% | | | 7% | 4% |
| 2-HMP | 51 | 93 | 47 | 18 | 10 | 9 | 8.8 | 34 | 150 |
| | 56 | 99 | 59 | 20 | 14 | 9 | 8.9 | 37 | 161 |
| | 54 | 99 | 48 | 25 | 6 | 10 | 9.1 | 38 | 154 |
| 2-PG | 83 | 68 | 38 | 23 | 1 | 10 | 8.9 | 32 | 144 |
| | 80 | 61 | 46 | 31 | 9 | 9 | 8.9 | 32 | 148 |
| | 82 | 67 | 27 | 13 | 1 | 9 | 8 | 32 | 153 |
| 3-PDP | 81 | 70 | 39 | 13 | 11 | 9 | 8 | 32 | 156 |
| | 81 | 70 | 39 | 13 | 11 | 9 | 8 | 32 | 156 |
| | 77 | 68 | 32 | 28 | 7 | 9.7 | 8.9 | 32 | 160 |
| | 81 | 69 | 39 | 31 | 17 | 9.3 | 8.9 | 35 | 162 |
| 2-PE | 44 | 85 | 45 | 26 | 18 | 9 | 8.3 | 30 | 138 |
| | 47 | 89 | 50 | 17 | 5 | 9 | 8.8 | 29 | 149 |
| | 48 | 84 | 50 | 11 | 4 | 9 | 8.3 | 27 | 151 |
| N-PE | 25 | 92 | 49 | 21 | 9 | 10 | 8.9 | 31 | 157 |
| | 41 | 94 | 64 | 27 | 5 | 9 | 8.8 | 34 | 140 |
| | 32 | 82 | 54 | 22 | 19 | 9 | 8.8 | 32 | 150 |
| 4-PE | 57 | 93 | 52 | 21 | 5 | 9 | 8 | 28 | 136 |
| | 55 | 95 | 46 | 13 | 9 | 9 | 7.9 | 27 | 145 |
| | 61 | 99 | 63 | 16 | 9 | 9 | 7.9 | 36 | 132 |
| 4-HP | 69 | 100 | 79 | 23 | 13 | 8 | 7.8 | 31 | 144 |
| | 64 | 81 | 37 | 25 | 7 | 8 | 7 | 26 | 136 |
| | 81 | 93 | 66 | 19 | 11 | 8 | 7.8 | 30 | 132 |

All of the above-mentioned references are herein incorporated by reference in their entirety to the same extent as if each individual reference was specifically and individually indicated to be incorporated herein by reference in its entirety.

While various embodiments have been described, it is to be understood that variations and modifications may be resorted to as will be apparent to those skilled in the art. Such variations and modifications are to be considered within the purview and scope of the claims appended hereto.

What is claimed is:

1. A smoking article comprising a surface-modified adsorbent comprising a reagent incorporated in a porous carrier, wherein the reagent comprises an analogue of 2-hydroxymethylpiperidine selected from the group consisting of 2-(2-piperidine)ethanol (2-PE), N-piperidineethanol (N-PE), 2-(4-piperidine)ethanol (4-PE), 3-hydroxypiperidine hydrochloride (3-HPH), 4-hydroxypiperidine (4-HP), 3-N-piperidinyl-1,2-propanediol (3-PDP), 2-amino-1-phenylethanol (2-APE), 2-(N-anilino)ethanol (2-AE), and S-(−)2-phenylglycinol (2-PG), in an amount effective to reduce constituents of mainstream tobacco smoke and ranging from 1 to 80% by weight of the adsorbent.

2. The smoking article of claim 1, wherein the porous carrier is selected from the group consisting of adsorbent carbon, activated carbon, silica gel, alumina, polyester resins, zeolites or zeolite-like materials, and mixtures thereof.

3. The smoking article of claim 1, wherein the porous carrier is activated carbon wherein: (a) the activated carbon comprises at least about 80% micropores; and either (b) the activated carbon has an average particle size from about 6 mesh to about 300 mesh; or (c) the activated carbon has an average particle size from about 0.2 mm to about 1 mm.

4. The smoking article of claim 1, wherein the reagent is incorporated in the carrier in an amount effective to reduce the concentration in mainstream tobacco smoke of one or more of carbon dioxide, hydrogen cyanide, ethane, 1,3-butadiene, isoprene, cyclohexadiene, 1,3-cyclohexadiene , methyl cyclopentadiene, formaldehyde, acetaldehyde, acrolein, acetone, diacetyl, methyl ethyl ketone, cyclopentanone, benzene, toluene, acrylonitrile, methyl furan, 2,5 dimethyl furan, hydrogen sulfide, methyl mecaptan, propene, propadiene, carbonyl sulfide, propionaldehyde, butyraldehyde, methanol, and 1-methyl pyrrole.

5. The smoking article of claim 1, wherein the reagent is incorporated in the carrier in an amount effective to reduce the concentration of hydrogen cyanide, 1,3-butadiene, formaldehyde, acetaldehyde, acrolein, diacetyl, acrylonitrile, and hydrogen sulfide in mainstream tobacco smoke by at least 90%.

6. The smoking article of claim 1, wherein the reagent is present in an amount of 3 to 10% by weight of the adsorbent.

7. A cigarette comprising a reagent incorporated in a porous carrier, wherein the reagent comprises an analogue of 2-hydroxymethylpiperidine (2-HMP) selected from the group consisting of 2-(2-piperidine)ethanol (2-PE), N-peridineethanol (N-PE), 2-(4-N-piperidine)ethanol (4-PE), 3-hydroxypiperidine hydrochloride (3-HPH), 4-hydroxyeridine (4-HP), 3-N-piperidinyl-1,2-propanediol (3-PDP), 2-amino-1-phenylethanol (2-APE), 2-(N-anilino)ethanol (2-AE), and S-(−)2-phenylqlycinol (2-PG), in an amount effective to reduce constituents of mainstream tobacco smoke and ranging from 1 to 80% by weight of the adsorbent.

8. The cigarette of claim 7, wherein the porous carrier is selected from the group consisting of adsorbent carbon, activated carbon, silica gel, alumina, polyester resins, zeolite or zeolite-like materials, and mixtures thereof.

9. The cigarette of claim 7, wherein the porous carrier comprises activated carbon having: (a) at least about 80% micropores; and either (b) an average particle size from about 6 mesh to about 300 mesh; or (c) an average particle size from about 0.2 mm to about 1 mm.

10. The cigarette of claim 7, wherein the porous carrier comprises beads located in a filter component of the cigarette.

11. The cigarette of claim 7, wherein the reagent is incorporated in the carrier in an amount effective to reduce the concentration in mainstream tobacco smoke of one or more of carbon dioxide, hydrogen cyanide, ethane, 1,3-butadiene, isoprene, cyclohexadiene, 1,3-cyclohexadiene, methyl cyclopentadiene, formaldehyde, acetaldehyde, acrolein, acetone, diacetyl, methyl ethyl ketone, cyclopentanone, benzene, toluene, acrylonitrile, methyl furan, 2,5 dimethyl furan, hydrogen sulfide, methyl mecaptan, propene, propadiene, carbonyl sulfide, propionaldehyde, butyraldehyde, methanol, and 1-methyl pyrrole.

12. The cigarette of claim 7, wherein the reagent is incorporated in the carrier in an amount effective to reduce the concentration of hydrogen cyanide, 1,3-butadiene, formaldehyde, acetaldehyde, acrolein, diacetyl, acrylonitrile, and hydrogen sulfide in mainstream tobacco smoke by at least 90%.

13. The cigarette of claim 7, wherein the reagent is present in an amount of 3 to 10% by weight of the adsorbent.

14. A cigarette filter including a surface-modified adsorbent, the surface modified adsorbent comprising a reagent incorporated in a porous carrier, wherein the reagent comprises an analogue of 2-hydroxymethylpiperidine selected from the group consisting of 2-(2-piperidine)ethanol (2-PE), N-piperidineethanol (N-PE), 2-(4-piperidine)ethanol (4-PE), 3-hydroxypiperidine hydrochloride (3-HPH), 4-hydroxypiperidine (4-HP), 3-N-piperidinyl-1,2-propanediol (3-PDP), 2-amino-1-phenlethanol (2-APE), 2-(N-anilino)ethanol (2-AE), and S-(−)2-phenylglycinol (2-PG), in an amount effective to reduce constituents of mainstream tobacco smoke and ranging from 1 to 80% by weight of the adsorbent.

15. The cigarette filter of claim 14, wherein the porous carrier is selected from the group consisting of adsorbent carbon, activated carbon, silica gel, alumina, polyester resins, zeolites or zeolite-like materials, and mixtures thereof.

16. The cigarette filter of claim 15, wherein the porous carrier is activated carbon wherein: (a) the activated carbon comprises at least about 80% micropores; (b) the activated carbon has an average particle size from about 6 mesh to about 300 mesh; (c) the activated carbon has an average particle size from about 0.2 mm to about 1 mm; or a combination of two or more of (a), (b), and (c).

17. The cigarette filter of claim 14, wherein the reagent is present in an amount effective to reduce the concentration in mainstream tobacco smoke of one or more of carbon dioxide, hydrogen cyanide, ethane, 1,3-butadiene, isoprene, cyclohexadiene, 1,3-cyclohexadiene, methyl cyclopentadiene, formaldehyde, acetaldehyde, acrolein, acetone, diacetyl, methyl ethyl ketone, cyclopentanone, benzene, toluene, acrylonitrile, methyl furan, 2,5 dimethyl furan, hydrogen sulfide, methyl mecaptan, propene, propadiene, carbonyl sulfide, propionaldehyde, butyraldehyde, methanol, and 1-methyl pyrrole.

18. The cigarette filter of claim 14, wherein the reagent is incorporated in the carrier in an amount effective to reduce the concentration of hydrogen cyanide, 1,3-butadiene, formaldehyde, acetaldehyde, acrolein, diacetyl, acrylonitrile, and hydrogen sulfide in mainstream tobacco smoke by at least 90%.

19. The cigarette filter of claim 14, wherein the filter comprises a plug-space-plug configuration and the surface-modified adsorbent is incorporated in the space between the plugs.

20. The cigarette filter of claim 14, wherein the reagent is present in an amount of 3 to 10% by weight of the adsorbent.

* * * * *